US005671675A

United States Patent [19]

Okuda et al.

[11] Patent Number: 5,671,675

[45] Date of Patent: *Sep. 30, 1997

[54] PRINT IMAGE TREATMENT DEVICE

[75] Inventors: Sadanao Okuda; Takashi Isozaki; Ryuji Higa; Takahito Tojima, all of Ibaraki-Ken, Japan

[73] Assignee: Riso Kagaku Corporation, Tokyo, Japan

[ * ] Notice: The term of this patent shall not extend beyond the expiration date of Pat. No. 5,476,043.

[21] Appl. No.: 627,354

[22] Filed: Apr. 5, 1996

[30] Foreign Application Priority Data

Apr. 13, 1995 [JP] Japan ..... 7-088379
Feb. 28, 1996 [JP] Japan ..... 8-041631

[51] Int. Cl.[6] ..... B41F 35/00

[52] U.S. Cl. ..... 101/424.2; 101/416.1; 118/46

[58] Field of Search ..... 101/117, 118, 101/114, 416.1, 417, 418, 423, 424, 424.2, 425; 118/46, 56, DIG. 1

[56] References Cited

U.S. PATENT DOCUMENTS 3,861,351 1/1975 Bonwit et al. ..... 101/424.2
4,836,129 6/1989 Dahlgren ..... 101/424.2
5,476,043 12/1995 Okuda et al. ..... 101/483

FOREIGN PATENT DOCUMENTS 59-203028 11/1984 Japan .
60-204543 10/1985 Japan .
63-149155 6/1988 Japan .
63-268649 11/1988 Japan .

*Primary Examiner*—Ren Yan
*Attorney, Agent, or Firm*—Kanesaka & Takeuchi

[57] ABSTRACT

The print image device according to this invention is comprised of a rotatable member with an excessive ink removing liquid applied to the surface, which does not dissolve in a printing ink forming a print image and has a lower surface tension than that of the printing ink; a facing member for bringing a printed surface of a printed body into contact with the excessive ink removing liquid on the contact member by nipping and carrying the printed body having been printed between the contact member and the facing member; a supply device for supplying the excessive ink removing liquid to the contact member; and a cleaning device for removing the excessive ink removing liquid with the printing ink, sliding in contact with the contact member. Furthermore, a mixture of the excessive ink removing liquid and the printing ink is formed at an upstream position in the rotating direction, i.e. in a contact part formed by the contact member and cleaning means on the contact member, where the quantity of the excessive ink removing liquid is controlled to be larger than one third of that of the printing ink.

10 Claims, 6 Drawing Sheets

STATE : 1 → PRINTING INK DISPERSION FLUID WITH EXCESSIVE INK REMOVING LIQUID AS DISPERSE MEDIUM
STATE : 2 → EXCESSIVE INK REMOVING LIQUID DISPERSION FLUID WITH PRINTING INK AS DISPERSE MEDIUM

PRINT IMAGE TREATMENT DEVICE

BACKGROUND OF THE INVENTION

The present invention relates to a print image treatment device used in a stencil printing device or the like. The present invention is effective as a measure particularly for a set-off and seeping-through in printing.

In a printing using liquid printing ink, there have been as problem: a set-off, a phenomenon that printing ink forming a print image on a printed sheet or body sticks to the back surface of another placed thereon, when printed bodies are piled up immediately after printing; a print image deformation occurring when a finger touches a print image surface immediately after printing; and a seeping-through, a phenomenon that printing ink forming a print image on a printed body penetrates through the printed body to the back surface.

These problems as mentioned above are apt to appear particularly in a stencil printing which uses more quantity of printing ink forming a print image on a printed body than the other type of printing.

Efforts have been made to reduce a quantity of ink applied to a printed body in a printing process to prevent a set-off, seeping-through, or the like from occurring. However, it is difficult to quantitatively control a quantity of ink; excessive control of a quantity of ink will cause a print image to thin or to blur, and will lower the printing quality.

To avoid problems as mentioned above, it is possible to heat and dry printing ink forming a print image, but this method needs to use a heater having a considerably high power. When a drying means by a heater or the like dries a printed body, conditions imposed on the drying means become more strict as the printing speed of a printing machine becomes higher. Practically, it is impossible to dry a printing ink in such a high speed as to prevent a set-off, seeping-through, or the like from occurring.

Furthermore, depending on a printing system, a fine powder such as starch or talc can be applied to a print image for preventing a set-off. However, a device applies these fine powders uses compressed air, so that a printing device having this type of device is apt to become considerably large.

When a printed body is transferred to a discharge paper tray, sorter, or the like after printing, it is impossible to allow a transfer roller to touch a print image on the printed body to keep the print image in good condition. Thus, a conveyer belt has been used to transfer a printed body, which touches only the back surface (non-printed surface) of the printed body. The printed body transfer device of this type has been disclosed in, for instance, Japanese Patent Laid-Open No. 50-88769.

However, compared to a transfer system used in a PPC copy machine or the like that transfers a copying paper forcibly by nipping both sides, the system transferring a printed body without touching the print image surface, but touching the back surface only, creates irregularities in paper setting in a transferred place such as a discharged paper tray or sorter; consequently deteriorating the neatness of a discharged paper. This tendency becomes more obvious as a printing speed, in other words, a paper discharging speed becomes higher. And, these problems drastically reduce the degree of freedom for designing a paper carrying and discharging path in the printing device.

In addition to these, a system has been proposed wherein an excessive printing ink on a printed body is transferred onto a roller being in touch with the printed body and removed by a cleaning means such as a blade.

The inventors of the present invention invented a new device that removes an excessive printing ink from a printed sheet or body to enhance the quality of printing. This device comprises a contact roller on the surface of which an excessive ink removing liquid is applied in a layered form while rotating, and a facing roller rotating face to face with the contact roller to carry the printed body by the contact roller and facing roller. And, it transfers the excessive printing ink of a print image on the printed body to the excessive ink removing liquid applied in a layered form on the contact roller; the excessive printing ink on the contact roller is removed by a cleaning means such as a blade being in contact with the contact roller.

The above-mentioned device uses for an excessive ink removing liquid a fluid not dissolving the ink and having a lower surface tension than the printing ink, and applies this fluid in a layered form onto the contact roller.

However, if there occurs a change in the relation between the quantity of the excessive ink removing liquid to be supplied to the contact roller and the transfer quantity of the printing ink to the roller, the printing ink having been transferred to the contact roller will pass through the cleaning means such as a blade and again come into contact with the print image surface, leading to blurring the print image surface.

The cleaning means such as a blade was not effective enough for performing a perfect cleaning; it was found necessary to disperse the excessive printing ink having transferred to the contact roller into the excessive ink removing liquid.

SUMMARY OF THE INVENTION

In view of the problems in the system mentioned above, the present invention intends to improve the aforementioned excessive ink removing device based on the inventors' proposition and to reliably prevent a set-off, seeping-through or the like from occurring on the printed body without other faults induced. Therefore, it is an object of the present invention to provide a print image treatment device capable of removing the excessive printing ink of the print image reliably, and not blurring the print image when the contact roller comes again into contact with the print image on the printed body.

The print image treatment device as defined in the first aspect of the invention comprises a contact member being driven to rotate and having an excessive ink removing liquid applied to the surface, which does not dissolve in a printing ink forming a print image and has a lower surface tension than that of the printing ink; a facing member for bringing a printed surface of a printed sheet or body into contact with the excessive ink removing liquid on the contact member the printed body having been printed being transferred between the contact member and the facing member; a supply means for supplying the excessive ink removing liquid to the contact member; a cleaning means for removing the excessive ink removing liquid with the printing ink, sliding in contact with the contact member. Furthermore, in a mixture of the excessive ink removing liquid and the printing ink at an upstream position in the rotating direction to the contact part formed by the contact member and the cleaning means on the contact member, the quantity of the excessive ink removing liquid is larger than one third of that of the printing ink.

The print image treatment device as defined in the second aspect of the invention is that, in the print image treatment device in the first aspect, the cleaning means is formed of a plate member being in contact with a surface of the contact member in front of the top, in the rotating direction of the contact member.

The print image treatment device as defined in the third aspect is that, in the print image treatment device in the first aspect, the supply means supplies the excessive ink removing liquid on a surface of the contact member in front of the contact position formed by the cleaning means and the contact member, in the rotating direction of the contact member.

The print image treatment device as defined in the fourth aspect of the invention is that, in the print image treatment device in the first aspect, a recovery means for recovering the excessive ink removing liquid is in contact with a surface of the contact member in front of the contact position formed by the cleaning means and the contact member, in the rotating direction of the contact member.

The print image treatment device as defined in the fifth aspect of the invention is that, in the print image treatment device in the fourth aspect, the front end of the recovery means comes into close contact with a surface of the contact member with a specified length, and the rear end is placed at a position lower than that of the front end to guide downward the excessive ink removing liquid on the surface of the contact member.

The print image treatment device as defined in the sixth aspect of the invention is that, in the print image treatment device in the first aspect, the contact member is comprised of an endless belt loaded on a plurality of rollers.

The print image treatment device as defined in the seventh aspect of the invention is that, in the print image treatment device in the first aspect, the contact member is a contact roller to nip the printed body already printed between the facing member and the contact member.

The print image treatment device as defined in the eight aspect of the invention is that, in the print image treatment device in the first aspect, a copy reader calculates the printing rate of a copy in advance of printing, and a supply control means determines the quantity of the excessive ink removing liquid based on the printing rate of a copy calculated by the copy reader and the excessive printing ink rate representing the rate of the excessive printing ink quantity against the printing ink quantity having been transferred onto the printed body and supplies it from the supply means.

The print image treatment device as defined in the ninth aspect is that, in the print image treatment device in the eighth aspect, the supply control means controls the quantity of the excessive ink removing liquid per unit time to be supplied to the contact means so as to be larger than one third of the printing ink quantity per unit time transferred onto the contact member.

The print image treatment device as defined in the tenth aspect of the invention is that, in the print image treatment device in the eighth aspect, the printing is of the stencil printing, and the excessive printing ink rate is 10–30%.

In operation, the excessive ink removing liquid applied on the surface of the contact member comes into contact with the surface of the print image on the printed body. The excessive part of the printing ink forming the print image is transferred into the excessive ink removing liquid on the contact member, and is removed from the printed body. The excessive ink removing liquid does not dissolve in the printing ink forming the print image, and is a liquid having a lower surface tension than that of the printing ink. Thus, the excessive printing ink transferred into the excessive ink removing liquid is in a floating state on the surface of the excessive ink removing liquid. As the contact member rotates, the excessive printing ink being in a floating state on the surface of the contact member is removed from the contact member with the excessive ink removing liquid by the cleaning means being in contact with the surface of the contact member; and it is dispersed into the excessive ink removing liquid standing between the cleaning means and the contact member. This dispersion is composed of an emulsion by the excessive ink removing liquid of the outer phase and the printing ink of the inner phase. Therefore, the printing ink contained in the excessive ink removing liquid will not pass through the cleaning means; the printing ink on the contact means will reliably be removed.

DETAILED DESCRIPTION OF THE PREFERRED EMBODIMENTS

Figure 1:
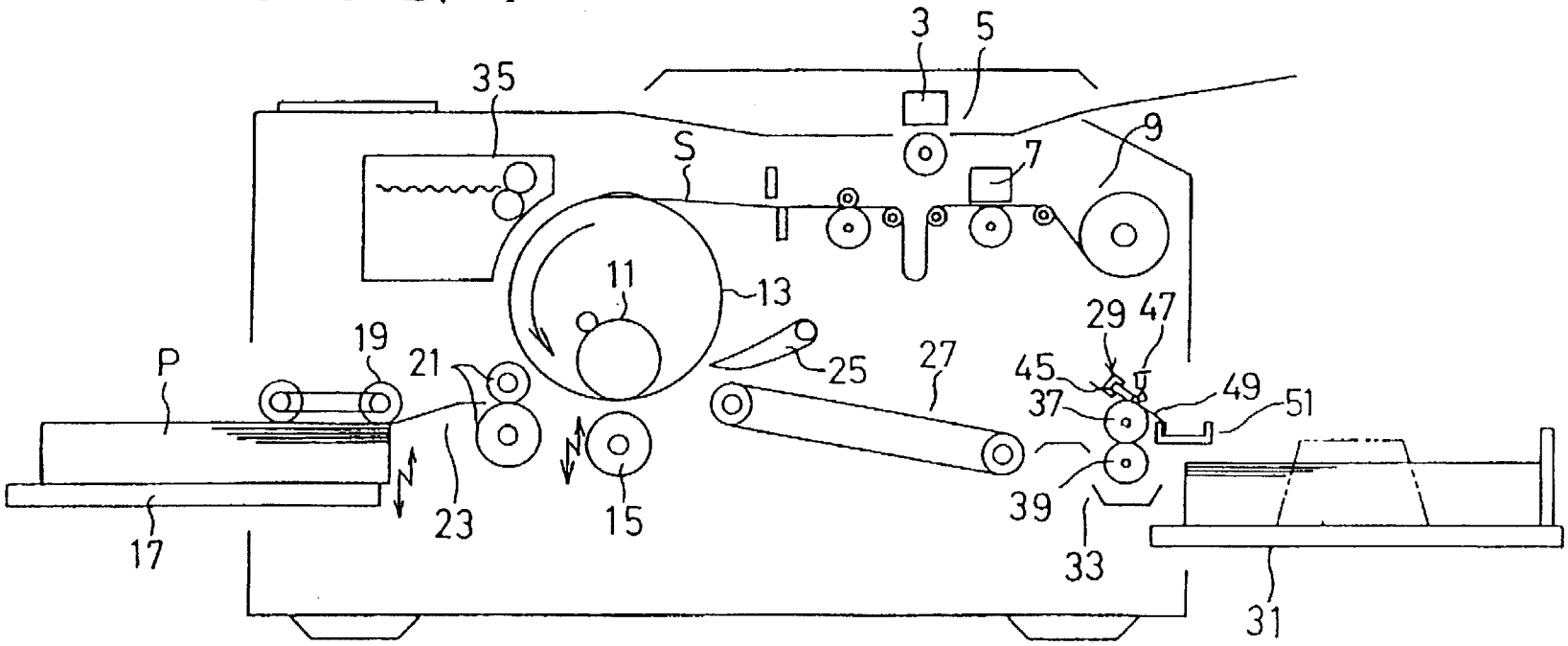
FIG. 1 is a plan view illustrating the constitution of one embodiment based on the present invention.

The constitution of the stencil printing device used in the first embodiment will be described with reference to FIG. 1 and FIG. 2. A copy image reader 5 has an image scanner 3 to read a copy image for printing and performs a specific image processing. A perforator 9 has a perforating device 7 to form a perforated image on a stencil sheet S for the stencil printing according to copy image data read by the copy image reader 5. As described later, the printing rate of a copy is given by the copy image reader 5.

The stencil sheet S for the stencil printing perforated by the perforator 9 is wound up around the circumference of a cylindrical printing drum 13. Inside the printing drum 13, an ink supplier 11 including an ink squeegee is installed to supply ink to the inner surface of the printing drum 13. A press roller 15 movable up and down is placed under the printing drum 13. The press roller 15 and the printing drum 13 nip and carry a sheet or body P supplied between them, forming a print image on the sheet, which becomes a printed body P, (e.g. a sheet, such as a printing paper).

In a paper supply part 23, a paper feeder roller 19 feeds one by one the body P placed on a paper supply table 17, and the body P is fed into between the press roller 15 and the printing drum 13 by a paper supply timing roller 21.

In a paper discharging part 33, a sheet separater claw 25 peels off the printed body P from the printing drum 13.

The printed body P having been peeled off is carried to the print image after treatment device 29 by a conveyer 27 having a belt conveying mechanism. The print image treatment device 29 removes an excessive ink from the printed image on the printed body P. The printed body P having been treated is discharged and piled up onto a paper receiving tray 31.

The stencil sheet S for the stencil printing having completed a printing is taken off from the printing drum 13 by a stencil disposal part 35, and is disposed.

The printing operation will now be described based on the foregoing constitution. The printing drum 13 rotates around its central axis in the counterclockwise direction in the drawing, which is driven by a driving means not illustrated in the drawing. The body P is carried, at a given timing synchronized with the rotation of the printing drum 13, from left to right in the drawing by the paper supply timing roller 21, and is fed into a portion between the printing drum 13 and the press roller 15. The body P is pressed by the press roller 15 toward the stencil sheet S wound around on the circumference of the printing drum 13, on which the stencil printing is applied.

The body P already printed is peeled off from the printing drum 13 by the sheet separater claw 25 and is guided to the print image treatment device 29 with the print image upward by the conveyer 27 for conveying a paper. The printed body P is treated by the print image treatment device 29, and is carried to the paper receiving tray 31 and piled up thereon.

The constitution and action of the print image treatment device 29 will now be described. As illustrated in FIG. 2, the print image treatment device 29 has a contact roller 37 for the contact member which comes into contact with the print image surface on the printed body P already printed, and a facing roller 39 for the facing member placed to face the contact roller 37. The contact roller 37 and the facing roller 39 are supported by spindles 41 and 43 in parallel and rotatably, respectively. The facing roller 39 is forced upward, toward the contact roller 37 by a spring as an forcing means not illustrated in the drawing. When the printed body P is not present between the contact roller 37 and the facing roller 39, the contact roller 37 and the facing roller 39 are in contact with each other.

A blade 45, a plate member having an approximately rectangular cross section is in contact with a circumference 37*a* (surface of an excessive ink removing liquid applied) of the contact roller 37. The base end of the blade 45 is fixed at an end of a metal member, the front end of the blade 45 is in contact with the contact roller 37.

The contact roller 37, facing roller 39, and blade 45 are comprised of a material which does not create changes in quality such as swelling by the excessive ink removing liquid. When the material for the excessive ink removing liquid is, for instance, silicon oil; the contact roller 37, facing roller 39, and blade 45 are preferably comprised of a fluorocarbon resin (rubber) to reduce the friction coefficient with the contact roller 37; but the materials are not particularly confined to a phenyl metamorphic silicon resin (rubber) or the like.

An excessive ink removing liquid supplying nozzle 47 is placed in front of the position where the contact roller 37 is in contact with the blade 45 in the rotating direction, above the circumference 37*a* of the contact roller 37. The excessive ink removing liquid supplying nozzle 47 is a means for supplying the excessive ink removing liquid onto the circumference 37*a* of the contact roller 37. The excessive ink removing liquid does not dissolve in the printing ink which forms the print image, and has a lower surface tension than the printing ink.

When the excessive ink removing liquid supplying nozzle 47 supplies the excessive ink removing liquid onto the circumference 37*a* of the contact roller 37, the excessive ink removing liquid stands between the blade 45 and the contact roller 37. As the contact roller 37 rotates, the excessive ink removing liquid passes through between the contact roller 37 and the blade 45, and forms a layer on the surface of the contact roller 37. The blade 45 functions so as to uniformly supply the quantity of the excessive ink removing liquid applied on the circumference 37*a* of the contact roller 37. Furthermore, the blade 45 functions as a cleaning means for removing dirts on the circumference 37*a* of the contact roller 37.

The excessive ink removing liquid used in this embodiment does not dissolve in the printing ink which forms the print image on the print image surface of the printed body P, and is a liquid having a lower surface tension than the printing ink. There are liquids to meet this condition, for instance, dimethyl-silicon oil, and modified-silicon oil with phenyl, polyether, fluorine, amino, epoxy, carboxyl, carbinol, methacryl, mercapto, or phenol to be used for the excessive ink removing liquid. The excessive ink removing liquid mentioned above is particularly effective for a water-in-oil type emulsion ink.

Furthermore, aqueous solutions with a surface active agent or an organic solvent added can be used for the excessive ink removing liquid.

As a surface active agent to be added in water, there are anion, cation, and ampholytic ionic and nonionic surface active agents. The addition rate of each of these surface active agents is determined so that the surface tension of the excessive ink removing liquid is lower than that of the printing ink.

As an organic solvent to be added in water, there may be a water-soluble organic solvent, i.e. methanol, ethanol, isopropyl alcohol, n-isopropyl alcohol, ethylene, glycol, and glycerin.

The excessive ink removing liquid and the excessive printing ink applied on the contact roller 37 can not flow smoothly due to the blade 45 together with the rotation of the contact roller 37. Only a small portion of them can pass through between the blade 45 and the contact roller 37; a large majority of them stands making a puddle in front of the blade 45 upstream in the rotating direction. The excessive printing ink transferred to the contact roller 37 from the printed body P is dispersed in the excessive ink removing liquid at the fluid puddle (f).

The quantity of the excessive ink removing liquid standing at the fluid puddle (f) must be larger than one third of that of the excessive printing ink thereat. To maintain the above-mentioned state, the quantity of the excessive ink removing liquid per unit time from the excessive ink removing liquid supplying nozzle 47 is set to be larger than one third of the printing ink per unit time transferred to the contact roller 37. This is controlled by the supply control means.

Figure 3:
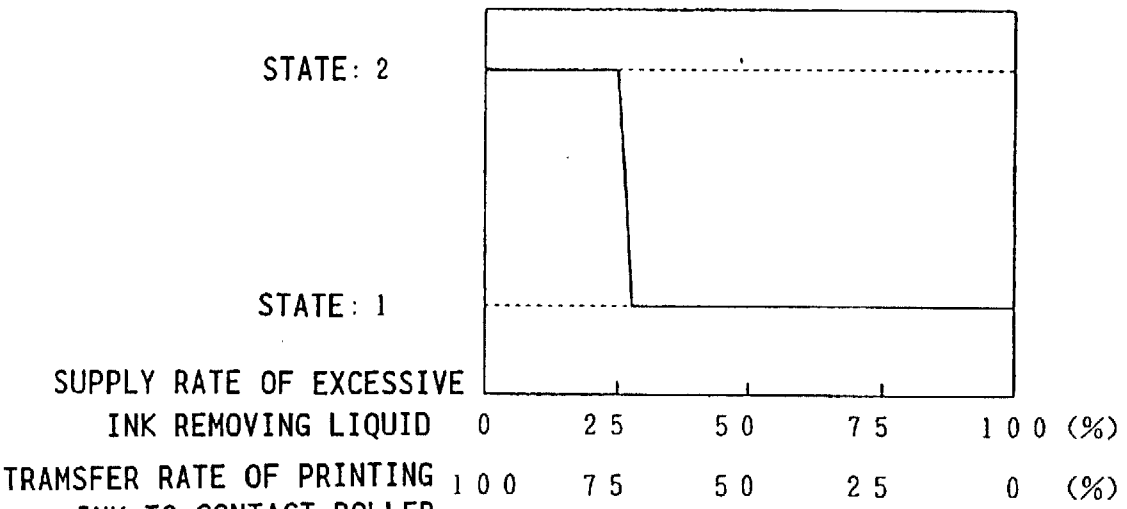
FIG. 3 is a graph representing the relation between the quantity of the excessive ink removing liquid and the quantity of the printing ink transferred to the contact roller.

FIG. 3 is a graph illustrating the relation between the quantity of the excessive ink removing liquid at the fluid puddle (f) and the printing ink quantity transferred to the contact roller 37.

As clearly seen in FIG. 3, when the quantity of the excessive ink removing liquid at the fluid puddle (f) exceeds one third (25% of the total quantity) of the quantity of the printing ink transferred to the contact roller 37, a printing ink dispersion fluid will be formed wherein the excessive ink removing liquid operates as a disperse medium at the fluid puddle (f).

When the quantity of the excessive ink removing liquid becomes smaller than one third of the printing ink quantity, an excessive ink removing liquid dispersion fluid will be formed while having the printing ink as a disperse medium. In this state, the excessive ink removing liquid dispersion fluid with ink removed already passes through the blade 45, and again blurs the print image by transferring to the print image.

As shown in FIG. 3, a sheet elastic body 49 is formed slant in front of the blade 45 in the rotating direction of the contact roller 37, as a recovery means for the excessive ink removing liquid. The rear end of the sheet elastic body 49 is fixed at a receiver plate 51 for the excessive ink removing liquid, placed at a lower position than the aforementioned contact point (d).

The action of the print image treatment device 29 constituted as above will now be described. The contact roller 37 and the facing roller 39 nip and carry the printed body P already printed. The film (a) of the excessive ink removing liquid formed on the circumference 37*a* of the contact roller 37 comes in contact with the print image on the surface on the printed body P. This contact transfers the excessive part of the printing ink (b) forming the print image on the printed body P to the film (a) of the excessive ink removing liquid on the contact roller 37; the excessive part of the printing ink is removed from the printed body P.

The printing ink (c) having been transferred to the film (a) of the excessive ink removing liquid on the contact roller 37 passes through a part where the sheet elastic body 49 and the contact roller 37 slide in contact with each other with the rotation of the contact roller 37.

The excessive ink removing liquid used for this embodiment does not dissolve in the printing ink (b) forming the print image, and is a liquid having a lower surface tension than that of the printing ink (c).

And, the supply control means controls the quantity of the excessive ink removing liquid at the fluid puddle (f) so as to set it to always be larger than one third of the quantity of the printing ink.

Therefore, the fluid puddle (f) is composed of an emulsion by the excessive ink removing liquid of the outer phase and the printing ink of the inner phase. The printing ink of the inner phase is in a free floating state, separated from the excessive ink removing liquid of the outer phase.

The contact roller 37 rotates while keeping in contact with the blade 45. Taking a microscopical look at the contact part, contacts and gaps are seen aggregated. Since the size of the gaps is smaller than the diameter of most particles of the printing ink in the mixed fluid at the fluid puddle (f), the particles of the printing ink can not pass through, and the excessive ink removing liquid of the outer phase passes through the gaps.

Therefore, the film (a) of the excessive ink removing liquid is formed again without containing the printing ink (c) on the circumference 37*a* of the contact roller 37, after the excessive ink removing liquid passes through the blade 45. The contact roller 37 having the film (a) of the excessive ink removing liquid without containing the printing ink (c) comes into contact with a subsequent print image on the printed body P; and therefore, the print image on the printed body P will not be blurred by the printing ink (c) having been transferred to the contact roller 37.

Since the position where the blade 45 is in contact with the circumference 37*a* of the contact roller 37 is in front of the top of the contact roller 37 in the rotating direction, when the liquid quantity in the fluid puddle (f) exceeds a certain limit, even if the contact roller is rotating, the excessive ink removing liquid dispersion fluid in the fluid puddle (f) flows out by its weight in the reverse direction to the rotation of the contact roller 37. The overflowing excessive ink removing liquid dispersion fluid is guided to flow on the slant surface of the sheet elastic body 49, and is recovered into the receiving box plate 51.

As described above, the printed body P passes through between the contact roller 37 and the facing roller 39; the excessive part of the printing ink (b) forming the print image is reliably removed from the circumference 37*a* of the contact roller 37. Consequently, the occurrence of the set-off or seeping-through is reduced in the printed body already printed. When the print image surface is touched by a finger or the like immediately after being discharged, the print image becomes immune from being deformed, and drying the printing ink (b) forming the print image can be done in a shorter time.

The quantity of the excessive ink removing liquid to be supplied to the fluid puddle (f) needs to be changed corresponding to the quantity of the printing ink transferred to the printed body P by a printing machine. The transfer quantity of the printing ink to the printed body P by a printing machine changes according to the printing rate (area perforated/area allowable of printing).

This printing rate is acquired by the copy reader 5 for reading the copy and processing the print image, when the perforating of a stencil sheet S for a stencil printing is conducted according to the copy at the perforator 9 in advance of printing operation.

In case of a stencil printing, the excessive printing ink on the printed body P amounts to 10–30% of all the quantity of the printing ink having been transferred to the printed body P; this is an excessive printing ink rate.

Therefore, the quantity of the excessive ink removing liquid to be supplied to the fluid puddle (f) is determined by the printing rate Judged by the copy reader 5 and the excessive printing ink rate (maximum value fixed at 30% of the total quantity of the printing ink having been transferred to the printed body P).

Figure 4:
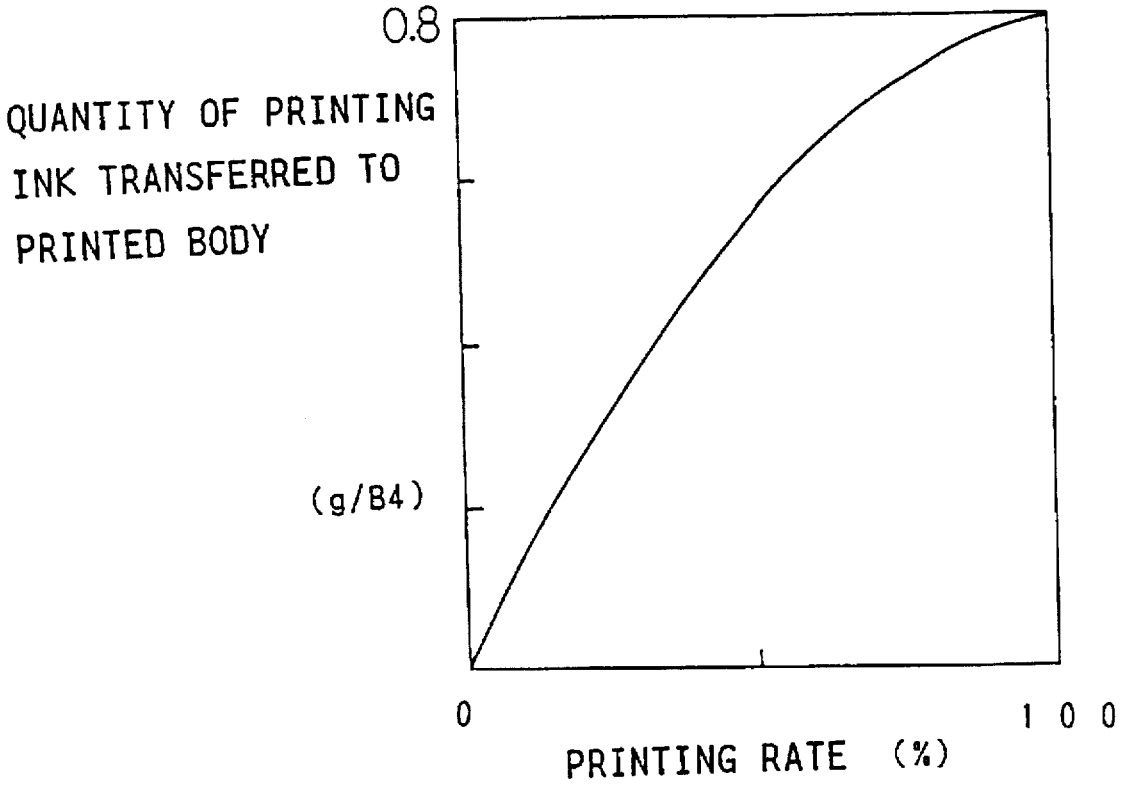
FIG. 4 is a graph representing the relation between the printing rate and the quantity of the printing ink transferred to the printed body.

Applying the printing rate to the horizontal axis and the quantity of the printing ink transferred to the printed body P to the vertical axis will produce a graph as shown in FIG. 4. The relation shown in FIG. 4 enables the calculation of the printing ink quantity transferred to the printed body P, through calculation of the printing rate by a copy reader including CCD.

Defining 30% of the calculated quantity of the printing ink as the maximum value, the quantity of the printing ink transferred to the contact roller 37 will be determined.

Applying the excessive ink removing liquid to the contact roller 37 with the quantity more than one third of that of the printing ink transferred to the contact roller will reliably remove the printing ink without allowing it to pass through the gaps between the contact roller 37 and the blade 45.

Concretely, based on the printing rate and the excessive printing ink rate described above, the supply control means calculates the quantity of the foregoing excessive ink removing liquid and supplies the excessive ink removing liquid to the contact roller 37 so that the quantity to be supplied to the fluid puddle (f) will become equal to the calculated quantity.

Here, since the quantity per unit time of the excessive ink removing liquid supplied by the excessive ink removing liquid supplying nozzle 47 is set to be larger than one third of the quantity per unit time of the printing ink transferred to the contact roller 37, the printing ink will not pass through the gaps between the contact roller 37 and the blade 45 and will be removed reliably.

Next, another mode of the embodiment according to the present invention will be described with reference to FIG. 5.

Figure 2:
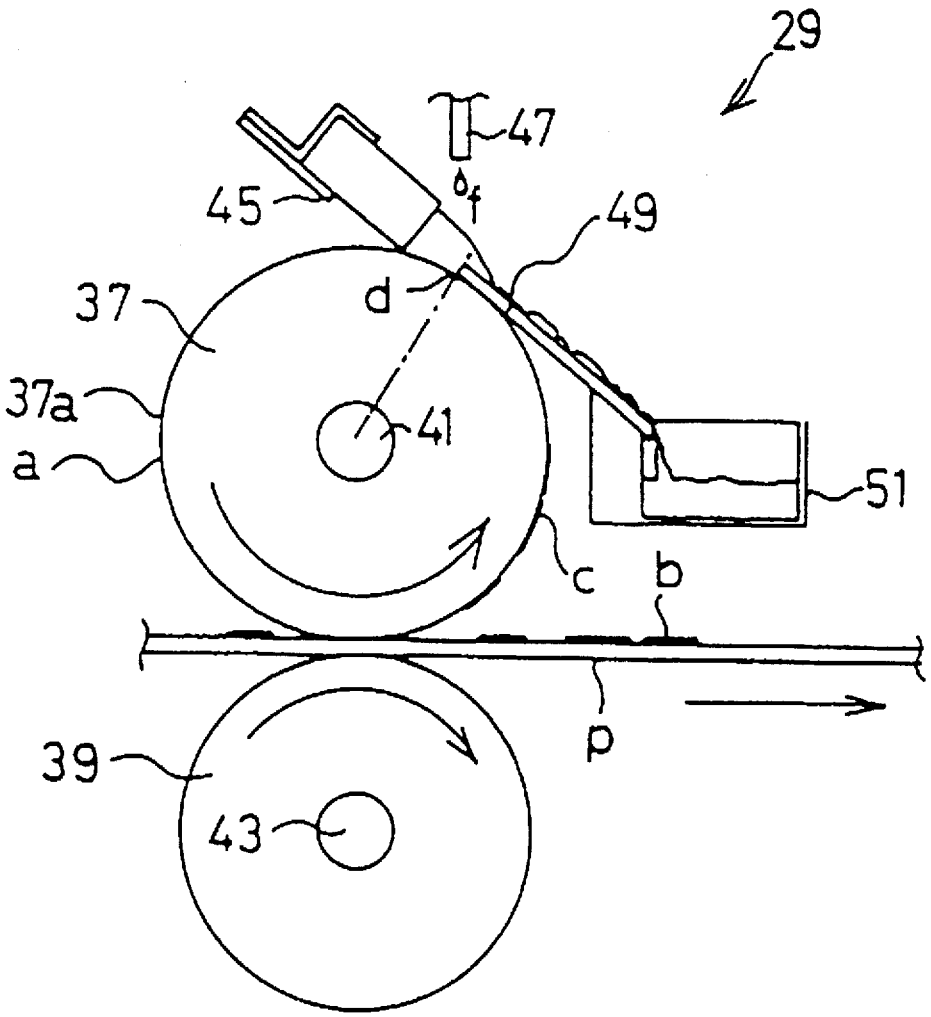
FIG. 2 is a constitutional plan view of the print image treatment device in FIG. 1.
Figure 5:
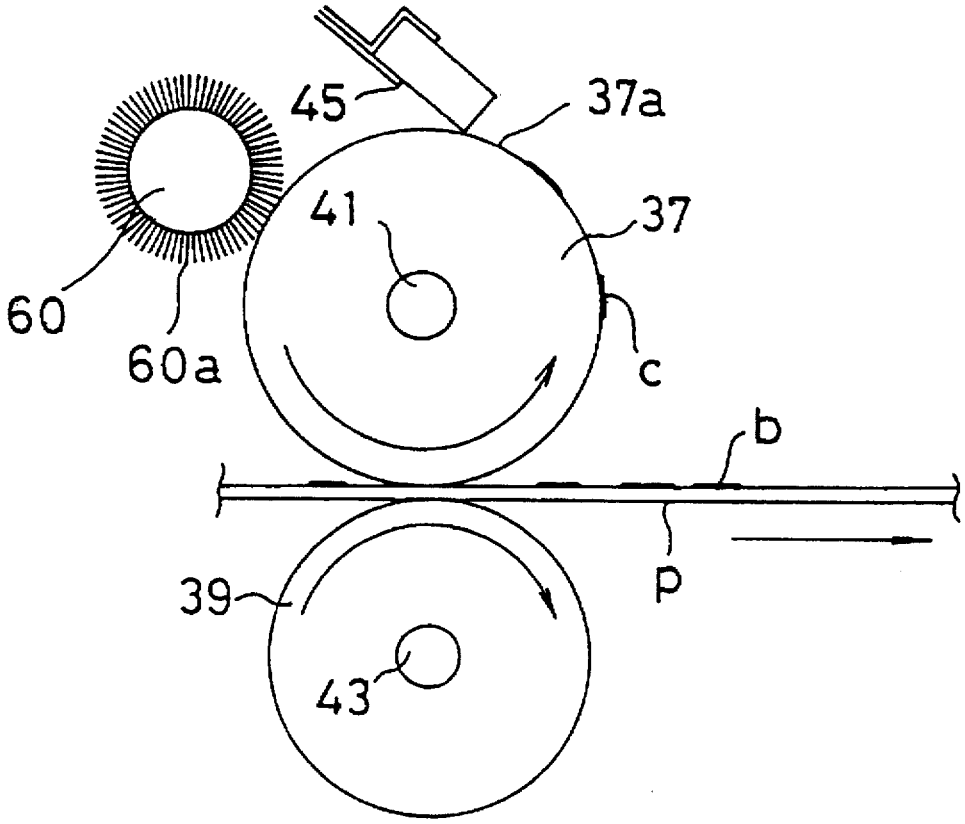
FIG. 5 is a plan view illustrating another constitution of the print image treatment device.

The parts in FIG. 5 corresponding to those in FIG. 2 are given the same reference numbers as given in FIG. 2, and the description thereof will be omitted.

In this mode of the embodiment, an application roller 60 is installed in contact with the contact roller 37, in replacement of the excessive ink supplying nozzle 47 as a supply means. The application roller 60 rotates as the contact roller 37 rotates.

The application roller 60 has a cylindrical form, holds the excessive ink removing liquid inside, and supplies the excessive ink removing liquid to the contact roller 37 by a constant quantity through small holes formed on its circumference. Around the circumference of the application roller 60, an application member 60*a* made of a paper, nonwoven fabric, woven fabric, or the like is wound up; the excessive ink removing liquid penetrating out from inside is applied uniformly through the application member 60*a*. This mode of the embodiment will produce a similar effect to the foregoing embodiment.

Figure 6:
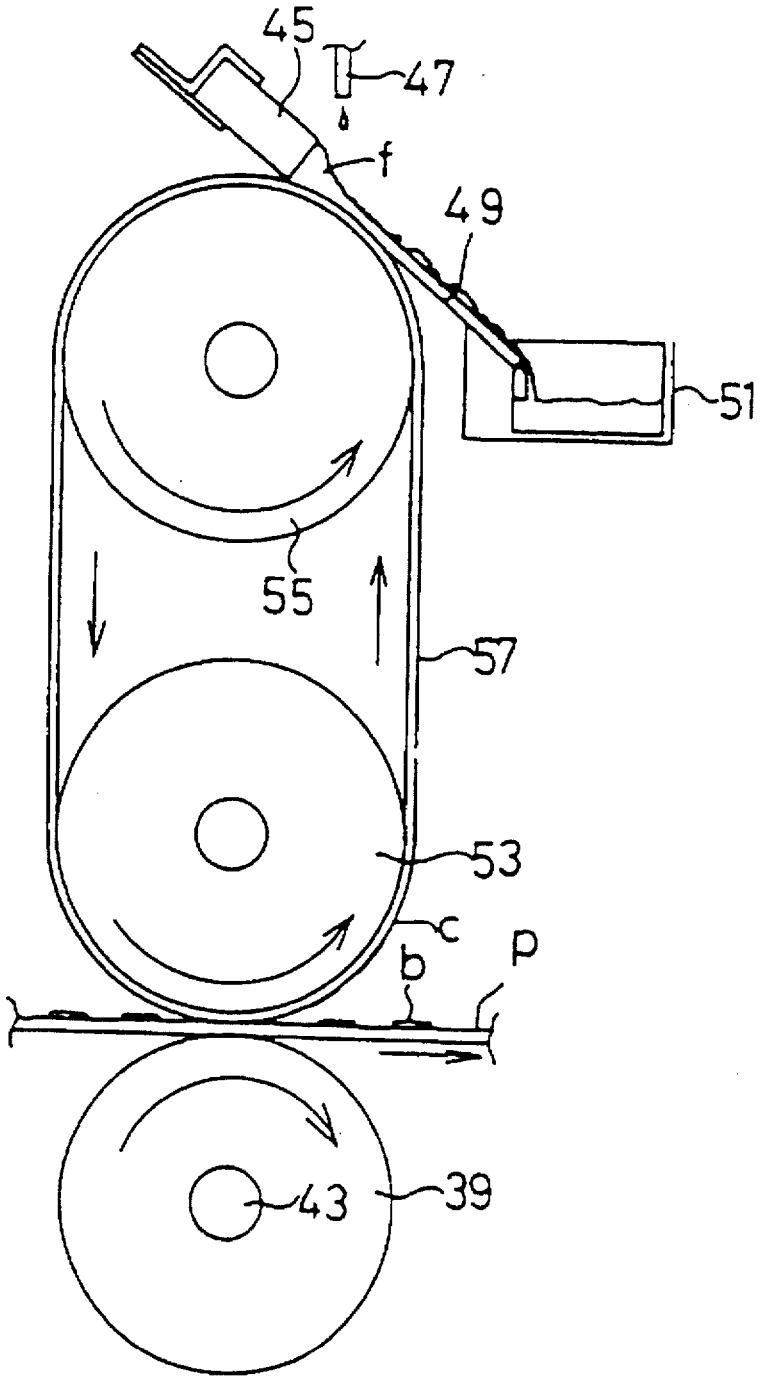
FIG. 6 is a plan view illustrating the other constitution of the print image treatment device.

Next, the other mode of the embodiment according to the present invention will now be described with reference to FIG. 6. In this mode of the embodiment, a flexible endless belt 57 for a contact member is put on to bridge two rollers 53 and 55 placed separately in an upper and a lower position, with a certain tension applied. This mode of the embodiment will produce a similar effect to the foregoing embodiment.

According to the present invention, the contact member such as the contact roller having the excessive ink removing liquid in a layer on its surface comes into contact with the print image on a surface of printing paper. This contact will completely remove the excessive part of the printing ink forming the print image on the printed body; and therefore, the set-off or the seeping-through will reliably be prevented without other defects induced, and the print image will hardly be deformed by finger-rubbing directly after the printed body having been discharged.

The excessive ink removing liquid does not dissolve in the printing ink forming the print image, and is a liquid having a lower tension than that of the printing ink; and therefore, an emulsion is formed at the fluid puddle by the excessive ink removing liquid of the outer phase and the printing ink of the inner phase. In this state, the printing ink will not pass through the gaps between the contact member and the blade as a cleaning means and can be removed from the surface of the contact roller; therefore, the printed body will not be blurred.

What is claimed is:

1. A print image treatment device comprising: a contact member being driven to rotate with having an excessive ink removing liquid applied to a surface thereof, which does not dissolve in a printing ink forming a print image and has a lower surface tension than that of the printing ink; a facing member for bringing a printed surface of a printed body into contact with the excessive ink removing liquid on the contact member by nipping and carrying the printed body having been printed between the contact member and the facing member; a supply means for supplying the excessive ink removing liquid to the contact member; and a cleaning means for removing the excessive ink removing liquid with the printing ink, sliding in contact with the contact member; characterized in that, in a mixture of the excessive ink removing liquid and the printing ink at an upstream position in the rotating direction to the contact part formed by the contact member and cleaning means on the contact member, the quantity of the excessive ink removing liquid is larger than one third of that of the printing ink.

2. A print image treatment device according to claim 1, wherein the cleaning means is formed of a plate member being in contact with a surface of the contact member in front of a top of the contact member, in the rotating direction of the contact member.

3. A print image treatment device according to claim 1, wherein the supply means supplies the excessive ink removing liquid on the surface of the contact member in front of the contact part formed by the cleaning means and the contact member, in the rotating direction of the contact member.

4. A print image treatment device according to claim 1, further comprising recovery means for recovering the excessive ink removing liquid contacting the surface of the contact member in front of the contact part formed by the cleaning means and the contact member, in the rotating direction of the contact member.

5. A print image treatment device according to claim 4, wherein a front end of the recovery means comes into close contact with the surface of the contact member with a specified length, and a rear end is placed at a lower position than the front end to guide downward the excessive ink removing liquid on the surface of the contact member.

6. A print image treatment device according to claim 1, wherein the contact member is an endless belt and a plurality of rollers for wrapping the belt.

7. A print image treatment device according to claim 1, wherein the contact member is a contact roller to nip the printed body having been printed between the facing member and the contact member.

8. A print image treatment device according to claim 1, further comprising: a copy reader for calculating a printing rate of a copy in advance of printing; and supply control means for determining the quantity of the excessive ink removing liquid based on printing rate of the copy calculated by the copy reader and an excessive printing ink rate representing the excessive printing ink quantity against the printing ink quantity having been transferred onto the printed body, and supplying it from the supply means.

9. A print image treatment device according to claim 8, wherein the supply control means controls the quantity of the excessive ink removing liquid per unit time to the contact member so as to be larger than one third of the printing ink quantity per unit time transferred onto the contact member.

10. A print image treatment device according to claim 8, wherein the printing is of the stencil printing and the excessive printing ink rate is 10–30%.

* * * * *